US009093241B1

(12) United States Patent
Gatski

(10) Patent No.: US 9,093,241 B1
(45) Date of Patent: Jul. 28, 2015

(54) APPARATUS FOR REMOVING AND INSTALLING ELEVATED LIGHT BULBS

(71) Applicant: Frank Gatski, Las Vegas, NV (US)

(72) Inventor: Frank Gatski, Las Vegas, NV (US)

( * ) Notice: Subject to any disclaimer, the term of this patent is extended or adjusted under 35 U.S.C. 154(b) by 0 days.

(21) Appl. No.: 14/597,926

(22) Filed: Jan. 15, 2015

(51) Int. Cl.
*H01J 9/00* (2006.01)
*H01K 3/32* (2006.01)

(52) U.S. Cl.
CPC .. *H01J 9/003* (2013.01); *H01K 3/32* (2013.01)

(58) Field of Classification Search
CPC ..... H01K 3/32; H01J 9/003
See application file for complete search history.

(56) References Cited

U.S. PATENT DOCUMENTS

| | | | | |
|---|---|---|---|---|
| 3,342,519 | A * | 9/1967 | Hunt et al. | 81/53.12 |
| 5,317,939 | A * | 6/1994 | Marinescu | 81/53.11 |
| 7,131,352 | B1 * | 11/2006 | Saunders | 81/53.11 |
| 8,539,863 | B2 * | 9/2013 | Gatski | 81/53.11 |
| 8,555,749 | B2 * | 10/2013 | Gatski | 81/53.11 |

* cited by examiner

*Primary Examiner* — David B Thomas
(74) *Attorney, Agent, or Firm* — Greenberg Traurig, LLP

(57) ABSTRACT

An apparatus comprising a spring-biased translatable member extending through a collar; a gripping unit including a platform member attached to the translatable member, the platform member configured to receive an adhesive member; and a capture cone attached to an upper portion of the collar. In one version, the gripping unit includes an adhesive member configured to fit into a recessed area of the platform member. The adhesive member has a "tacky" surface for gripping and controlling a light bulb during removal and installation.

16 Claims, 5 Drawing Sheets

APPARATUS FOR REMOVING AND INSTALLING ELEVATED LIGHT BULBS

FIELD OF THE INVENTION

The embodiments of the present invention relate to an apparatus for changing light bulbs in elevated locations such as ceilings.

BACKGROUND

Exterior and indoor elevated lighting systems are very common and popular. One disadvantage of elevated lighting systems, whether exterior or interior, is the inconvenience and danger related to changing the associated light bulbs. For example, using a ladder to change elevated light bulbs is generally unsafe for people inexperienced at such tasks. The changing difficulties relate to any bulb type including incandescent, flood and compact fluorescent.

Thus, there exists a need for an apparatus configured to allow users to remove and install elevated light bulbs conveniently and safely.

SUMMARY

The embodiments of the present invention relate to an apparatus comprising a spring-biased translatable member extending through a collar; a gripping unit including a platform member attached to said translatable member, said platform member configured to receive an adhesive member; and a capture cone attached to an upper portion of said collar. In one embodiment, the gripping unit includes an adhesive member configured to fit into a recessed area of the platform member. The adhesive member has a "tacky" surface for gripping and controlling a light bulb during removal and installation.

In one specific embodiment, the apparatus comprises a translatable member extending through a collar, said translatable member having a base and shaft wherein the base is wider than the shaft; a gripping unit including a platform member attached to said translatable member, said platform member configured to receive an adhesive member; a capture cone attached to an upper portion of said collar; and a spring positioned around said shaft such that said spring rests between said base and capture cone within said collar.

Other variations, embodiments and features of the present invention will become evident from the following detailed description, drawings and claims.

DETAILED DESCRIPTION

Figure 1:
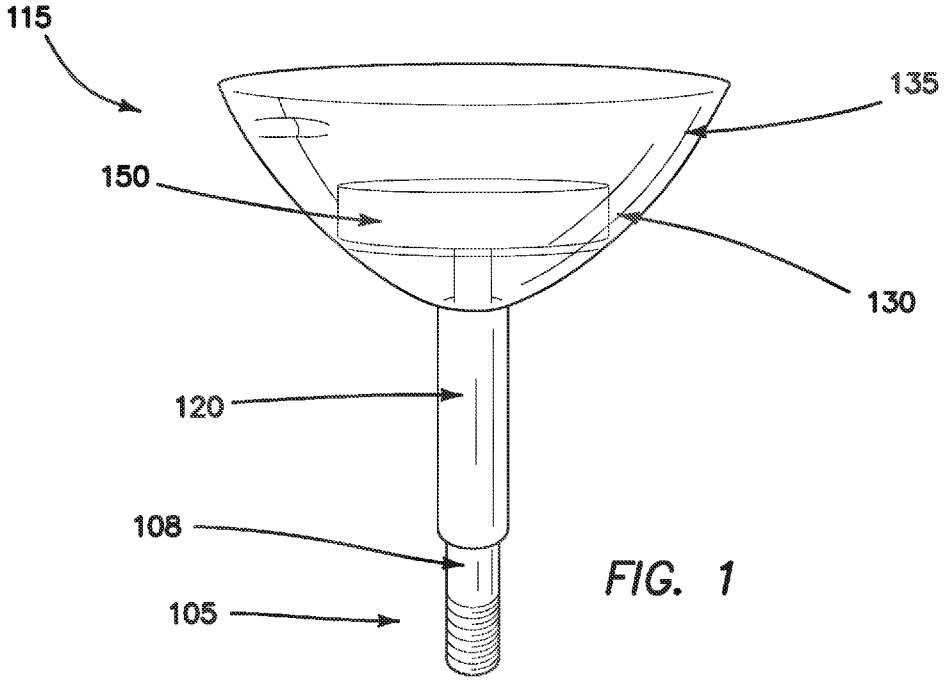
FIG. 1 illustrates a side view of a gripping unit of an apparatus for removing a light bulb according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 2A:
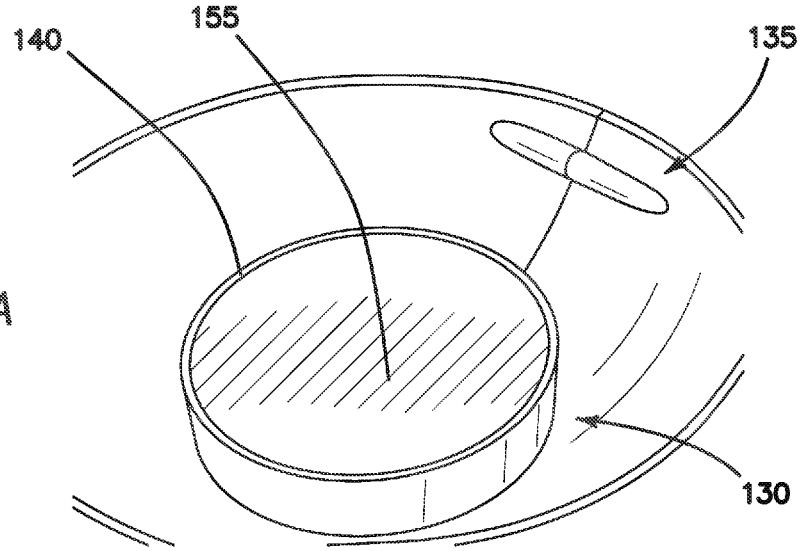
FIG. 2A illustrates an upper perspective view of the gripping unit of the apparatus of FIG. 1 according to the embodiments of the present invention.
Figure 2B:
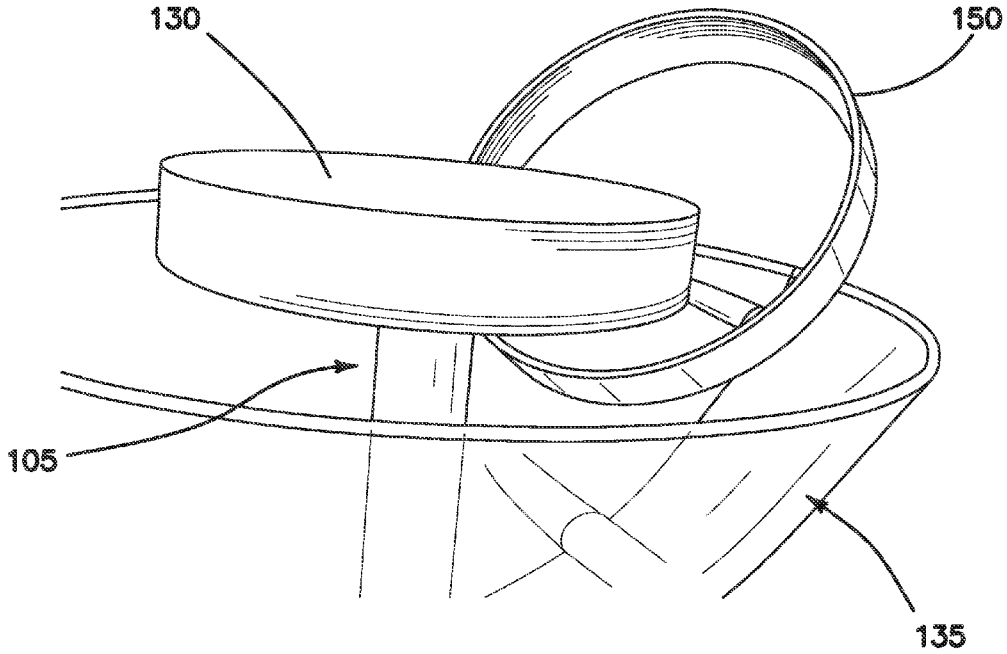
FIG. 2B illustrates the gripping unit partially disassembled according to the embodiments of the present invention.

FIGS. 1, 2A and 2B show an apparatus 100 for removing and installing light bulbs, normally from elevated locations such as exterior lights and interior lights recessed in high ceilings. The apparatus 100 comprises broadly a spring-biased translatable member 105 configured to attach to a pole 106 at a first end and a gripping unit 115 at a second end. The pole 106 may include a handle with finger indentations to accommodate a user's hand comfortably. The pole 106 may be telescoping to permit the apparatus 100 to be extended to accommodate various structures and lighting systems.

Figure 3:
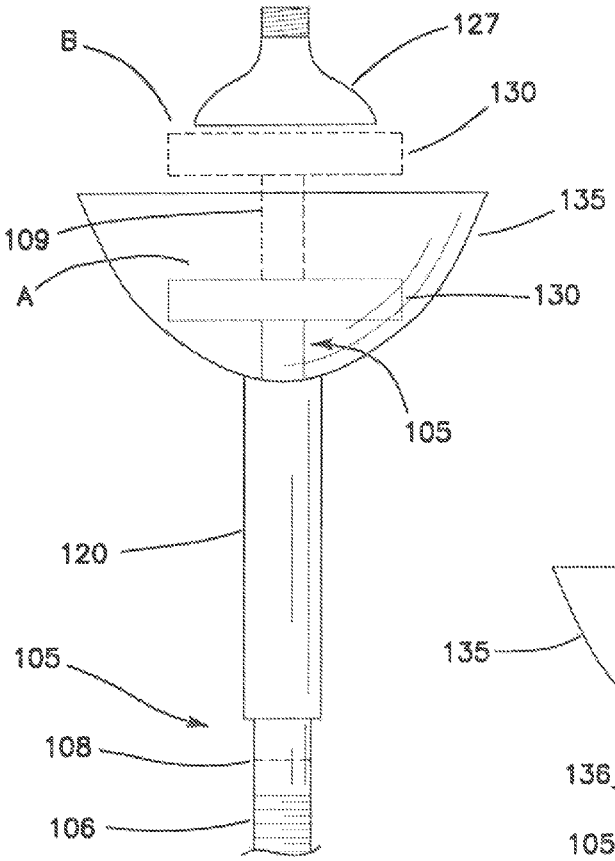
FIG. 3 illustrates a side view of the apparatus of FIG. 1 with a capture cone in a first position and second position.

The spring-biased translatable member 105 inserts through a collar 120 attached at a first end to a capture cone 125 configured to catch any light bulb which becomes unsecured during the removal or installation of the same. The spring-biased translatable member 105 includes a base 108 and shaft 109 with the base 108 being wider than the shaft. As best seen in FIG. 3, the spring-biased translatable member 105 is able translate through the collar 120 for removing or installing a light bulb. The spring-biased translatable member 105 is attached at a second end to a platform member 130. A capture cone 135 attaches to an upper end of the collar 120. A spring 137 resides within the collar between the spring-biased translatable member 105 and capture cone 135.

Figure 4:
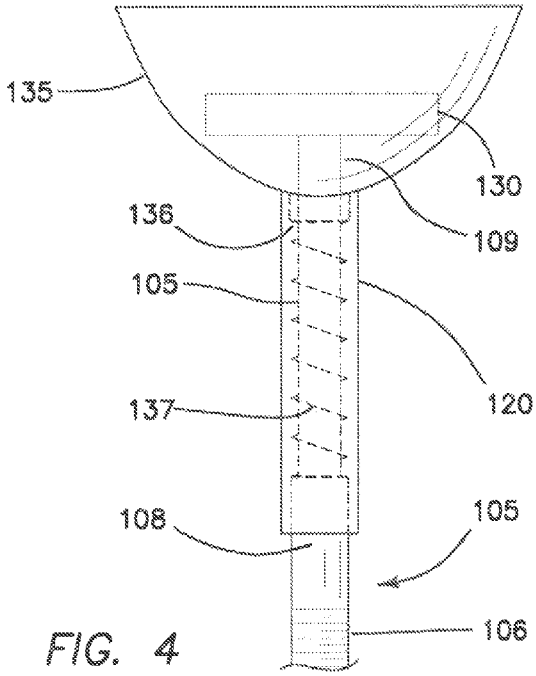
FIG. 4 shows a cross-sectional view of the apparatus according to the embodiments of the present invention.

FIG. 3 shows the spring-biased translatable member 105 and attached platform member 130 in a first position (A) and a second position (B) for reasons detailed hereinafter. To remove or install a light bulb the pole 106 is raised such that the capture cone 125 is positioned against a ceiling or recessed light housing at which time the pole 106 may be pushed upward forcing the spring-biased translatable member 105 to which it is connected to slide through said collar 120 compressing the spring 137 between against a stem or bottom 136 (seen in FIG. 4) of said capture cone 135 and said base 108 as the platform member 130 extends making contact with the light 127 (seen in FIG. 3). The spring 137 serves to return the gripping unit 115 to its home position once pressure against the capture cone 135 is released.

Figure 5:
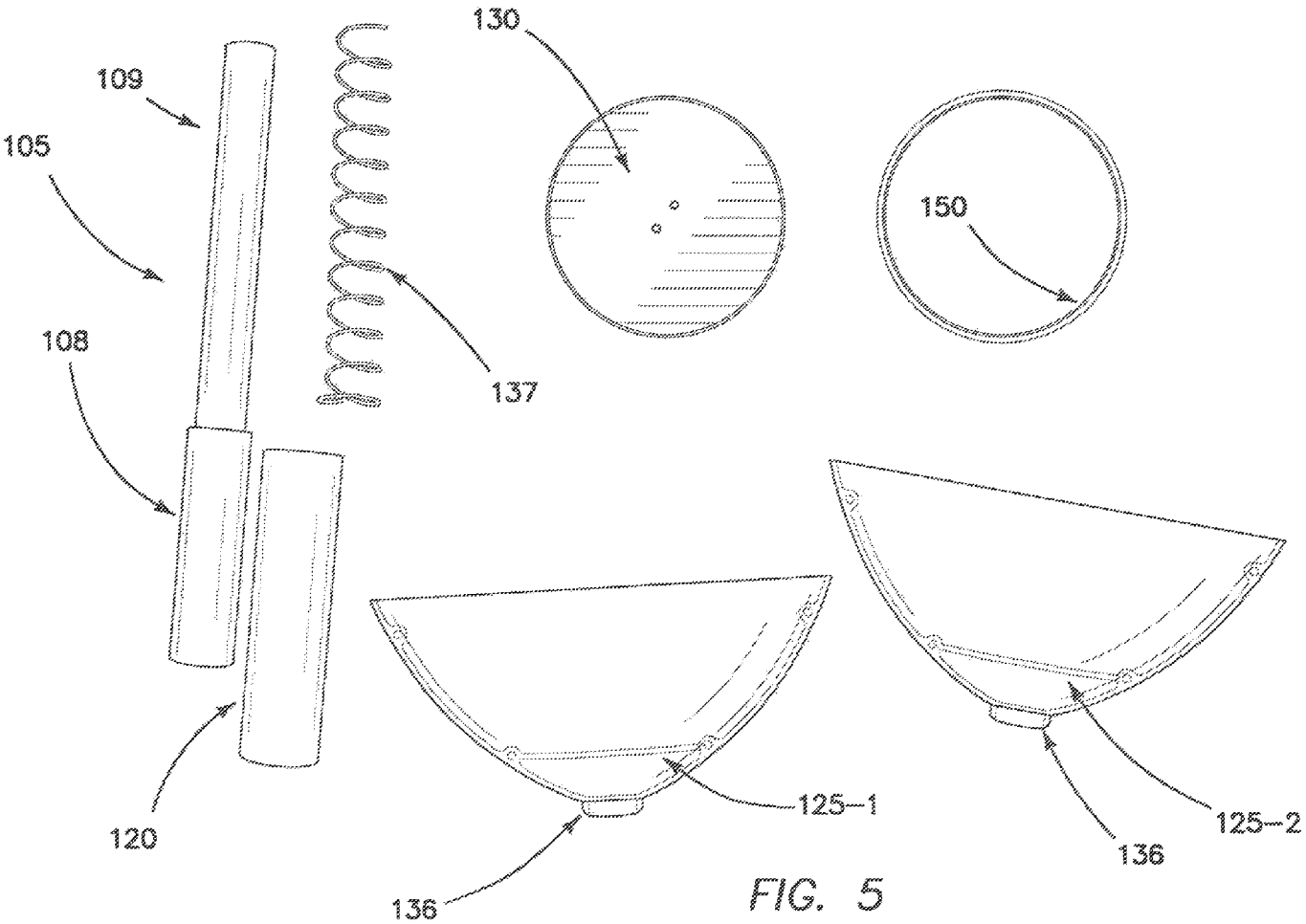
FIG. 5 illustrates individual components of the apparatus of FIG. 1 according to the embodiments of the present invention.

FIG. 5 shows individual components of the capture cone 125 and gripping unit 115. The capture cone 125 comprises two half-cone members 125-1 and 125-2 which fit together to form the capture cone 125. In one embodiment, the two half-cone members 125-1 and 125-2 are joined using screws. The stem 136 extending from a bottom of the assembled capture cone 125 fits into a top of the collar 120. The stem 136 may remain in the top of the collar 120 by means of friction, adhesive, fasteners or the like. The gripping unit 115 comprises the platform member 130 connected to an upper portion of said spring-biased translatable member 105. The platform member 130 includes a raised rim 140 about the circumference of the platform member 130 defining a recessed area 145. While the raised rim 140 is shown as a single continuous rim, it may be intermittent such that spaces within the raised rim exist about the circumference.

FIG. 5 shows a ring 150 configured to connect to platform member 130. FIG. 2B shows the ring 150 disengaged from the platform member 130. The upper edge of the ring 150 forms the raised rim 140. In one embodiment, the ring 150 connects to the platform member 130 via a threaded relationship. Other means, including adhesives, fasteners, friction and the like, of connecting the ring 150 and platform member 130 are conceivable within the spirit and scope of the present invention. FIG. 5 also shows the spring 137, translatable member 105 and collar 120.

Figure 6:
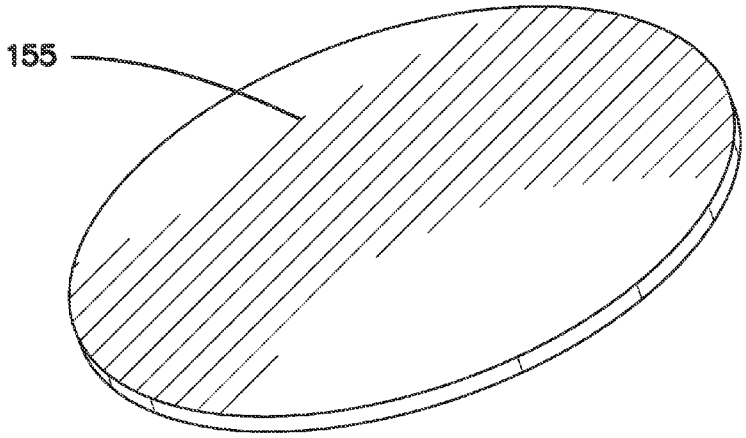
FIG. 6 illustrates an adhesive member according to the embodiments of the present invention.

Circular adhesive members 155 (shown in FIG. 6) are dimensioned to reside on the platform member 130 within the recessed area 145. In one embodiment, the adhesive members 155 have two sides of adhesive—a first side holding the adhesive member 155 on the platform member 130 and the second, opposite side for gripping and controlling a light bulb during removal and installation. Removal of the circular adhesive member 155 from the platform member 130 is facilitated by a finger hole 160 on the outer edge of the platform member 130. The finger hole 160 permits the user to grab an edge of the adhesive member 155 and remove it from the platform member 130.

Figure 7:
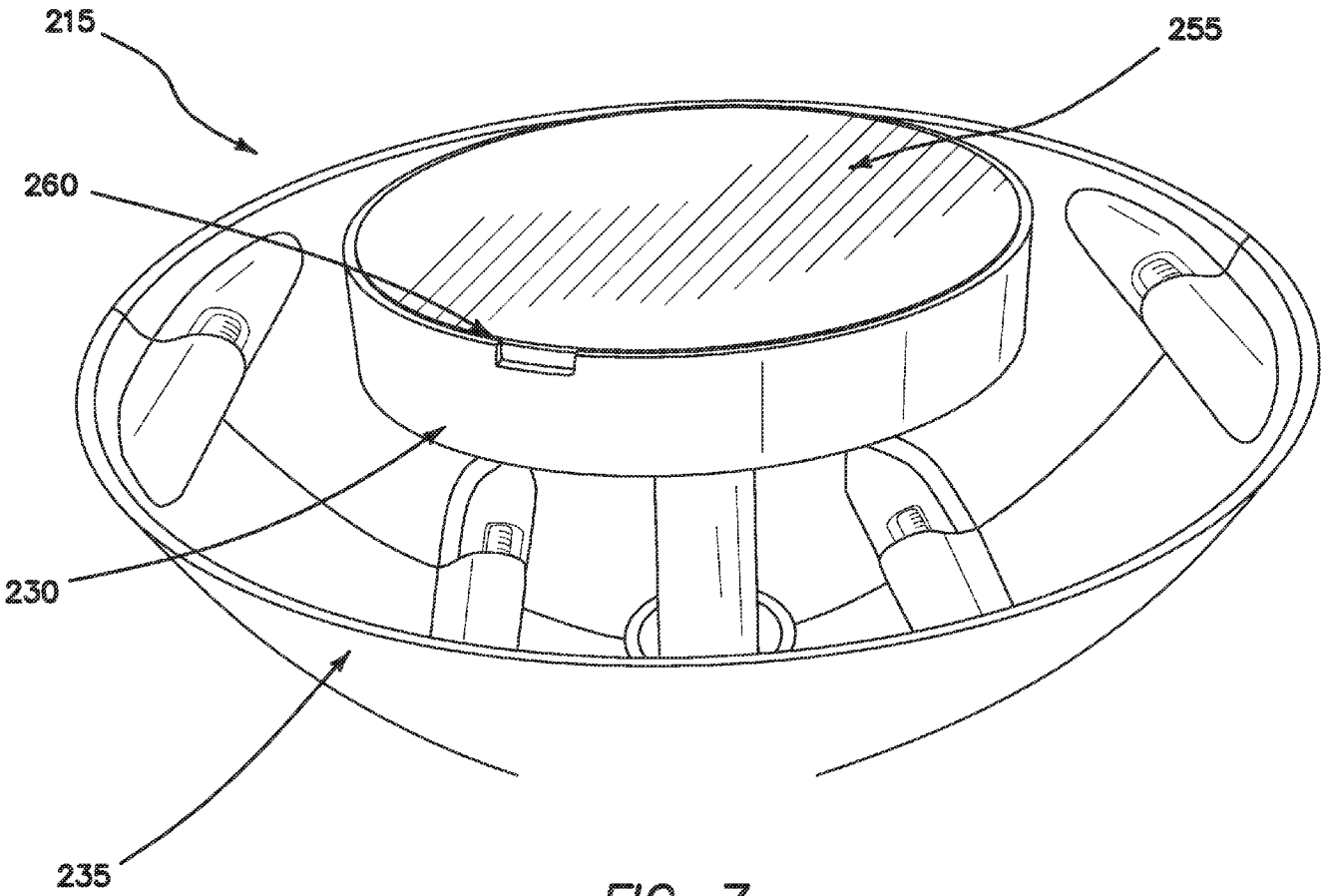
FIG. 7 illustrates another gripping unit having a single adhesive member according to the embodiments of the present invention.

FIG. 7 shows another gripping unit 215 having a capture cone 235 and platform 230. A single adhesive member 255 sits on top of said platform 230. A finger hole 260 permits a user to change out the adhesive member 255.

Although the invention has been described in detail with reference to several embodiments, additional variations and modifications exist within the scope and spirit of the invention as described and defined in the following claims.

I claim:

1. An apparatus comprising:

a spring-biased translatable member extending through a collar;

a gripping unit including a platform member attached to said translatable member, said platform member configured to receive an adhesive member, said platform member including a raised rim around an outer edge thereof; and a capture cone attached to an upper portion of said collar.

2. The apparatus of claim 1 wherein said raised rim is part of a ring circumscribing said platform member.

3. The apparatus of claim 1 wherein said platform member includes a finger hole on an edge thereof.

4. The apparatus of claim 1 wherein said platform member and adhesive member are circular.

5. The apparatus of claim 1 wherein said spring-biased translatable member is configured to attach to a pole.

6. The apparatus of claim 1 wherein said spring-biased translatable member has a base and shaft, said base member wider than said shaft.

7. An apparatus comprising:

a translatable member extending through a collar, said translatable member having a base and shaft wherein the base is wider than the shaft;

a gripping unit including a platform member attached to said translatable member, said platform member configured to receive an adhesive member said platform member includes a raised rim around an outer edge thereof;

a capture cone attached to an upper portion of said collar; and a spring positioned around said shaft such that said spring rests between said base and capture cone within said collar.

8. The apparatus of claim 7 wherein said raised rim is part of a ring circumscribing said platform member.

9. The apparatus of claim 8 wherein said platform member includes a finger hole on an edge thereof.

10. The apparatus of claim 8 wherein said translatable member is configured to attach to a pole.

11. An apparatus comprising:

a spring-biased translatable member extending through a collar;

a gripping unit including a platform member attached to said translatable member, said platform member configured to receive an adhesive member;

a capture cone attached to an upper portion of said collar; and wherein, via said spring-biased translatable member, said platform member may be moved relative to said collar and capture cone, said platform member includes a raised rim around an outer edge thereof.

12. The apparatus of claim 11 wherein said raised rim is part of a ring circumscribing said platform member.

13. The apparatus of claim 11 wherein said platform member includes a finger hole on an edge thereof.

14. The apparatus of claim 11 wherein said platform member and adhesive member are circular.

15. The apparatus of claim 11 wherein said spring-biased translatable member is configured to attach to a pole.

16. The apparatus of claim 11 wherein said spring-biased translatable member has a base and shaft, said base member wider than said shaft.

* * * * *